US012501948B1

(12) United States Patent
Krull

(10) Patent No.: US 12,501,948 B1
(45) Date of Patent: Dec. 23, 2025

(54) PACKABLE WATERPROOF FISHING WADER SYSTEM AND METHOD

(71) Applicant: Simms Fishing Products LLC, Bozeman, MT (US)

(72) Inventor: Clay T. Krull, Bozeman, MT (US)

(73) Assignee: Simms Fishing Products LLC, Bozeman, MT (US)

( * ) Notice: Subject to any disclaimer, the term of this patent is extended or adjusted under 35 U.S.C. 154(b) by 0 days.

(21) Appl. No.: 19/022,612

(22) Filed: Jan. 15, 2025

(51) Int. Cl.
*A41D 13/012* (2006.01)
*A41D 13/00* (2006.01)
*A41D 31/102* (2019.01)

(52) U.S. Cl.
CPC ..... *A41D 13/012* (2013.01); *A41D 13/0002* (2013.01); *A41D 31/102* (2019.02)

(58) Field of Classification Search
CPC .... A41D 31/102; A41D 13/012; A41D 13/02; A41D 27/20
See application file for complete search history.

(56) References Cited

U.S. PATENT DOCUMENTS 5,022,096 A * 6/1991 Pacanowsky ..... A41D 13/012 2/82
5,867,828 A * 2/1999 Shih ..... A41D 13/012 2/243.1
5,870,775 A 2/1999 Noyola
6,108,815 A 8/2000 Majerfeld
6,167,571 B1 * 1/2001 Cheng ..... A41D 13/02 2/87
6,280,807 B1 * 8/2001 Shih ..... A41D 13/0005 428/57
6,317,893 B1 * 11/2001 Walton ..... A41D 27/04 2/82

(Continued)

FOREIGN PATENT DOCUMENTS

GB 190013846 A 9/1900
GB 2490554 A * 11/2012 ..... A41D 27/245
KR 10-1106883 B1 1/2012

OTHER PUBLICATIONS

"Sonic-Pro Ultra Packable Wader" https://www.dreamdriftflies.com/products/sonic_pro_ultra_packable_wader_6682 (Accessed Jan. 16, 2025.).
"Patagonia Middle Fork Wader Review" https://tellurideangler.com/casting-pond/articles/patagonia-middle-fork-wader-review/ (Accessed Jan. 16, 2025.).

(Continued)

*Primary Examiner* — Katherine M Moran
(74) *Attorney, Agent, or Firm* — Reed Smith LLP; Matthew P. Frederick; Cheryl L. Gastineau

(57) ABSTRACT

A packable waterproof fishing wader and system, the wader including a body portion having an integral storage pocket; and right and left leg and foot portions. The foot portions each formed from at least a first laminated panel and a second laminated panel including an outer layer, a middle layer, an inner layer. The outer layer and the inner layer formed from a jersey knit material, and the middle layer formed from a neoprene material having a thickness of about 1 mm. A seam joining the laminated panels is a butt joint using butt stitching. Waterproof tape seals the seam. Laminated panel stretch characteristics are substantially equivalent to the waterproof tape percent elongation. The body portion, the right and left leg and foot portions are configured to be foldable into a storage configuration, and the storage configuration is entirely insertable into the integral storage pocket.

19 Claims, 14 Drawing Sheets

(56) References Cited

U.S. PATENT DOCUMENTS

| | | | | |
|---|---|---|---|---|
| 7,770,235 | B2 | 8/2010 | Lepage et al. | |
| 10,945,519 | B2 | 3/2021 | Chacker | |
| 2006/0150297 | A1 | 7/2006 | Turner | |
| 2010/0132089 | A1 | 6/2010 | Myers | |
| 2010/0306897 | A1* | 12/2010 | Wood | A41F 15/002 2/82 |
| 2013/0186786 | A1 | 7/2013 | Curtis | |
| 2020/0093245 | A1 | 3/2020 | Romano | |
| 2020/0196688 | A1* | 6/2020 | Beernink | A41D 13/012 |
| 2020/0214373 | A1 | 7/2020 | Wade | |
| 2022/0304401 | A1* | 9/2022 | Nelson | A41D 31/102 |
| 2023/0380521 | A1* | 11/2023 | Park | A41D 31/102 |

OTHER PUBLICATIONS

"RUNCL Chest Waders with Boots: Fishing Waders, Waist-High, Seamless Construction" https://www.temu.com/----------2----out-at--g-601099643589251.html?refer_page_name=goods&refer_page_id=10032_1729266607199_88w4uz7f78&refer_page_sn=10032&_x_sessn_id=w32xx7lw2d (Accessed Jan. 16, 2025.).

"Frogg Toggs Rana Lightweight Emergency Wader" https://www.froggtoggs.com/Rana-Emergency-Wader?srsltid=AfmBOooLvnghGP1530yb9RkTYX6du4FaNXZPE_fOaDI-UFookVWsSDih (Accessed Jan. 16, 2025.).

"Frogg Toggs® Amphib Neoprene Stockingfoot Chest Wader" https://www.froggtoggs.com/amphib-neopreme-stft-2716208?srsltid=AfmBOopBitKQnd6AThVYpuVEKiu2Q_Pb8w9Msdd3dBlxCbUprGRhEL64 (Accessed Jan. 16, 2025.).

* cited by examiner

PACKABLE WATERPROOF FISHING WADER SYSTEM AND METHOD

FIELD

Embodiments of the disclosure relate generally to wading systems. More particularly, embodiments of the disclosure relate to waterproof fishing wader systems and methods for making the same.

BACKGROUND

Waterproof waders may be used during fly fishing, hunting or other activities where it is desirable to keep the user's feet, legs and torso dry. Waterproof waders typically include a trunk portion, two leg portions and two foot portions joined together at various seams.

SUMMARY

According to certain embodiments, a packable waterproof fishing wader may include a body portion comprising an integral storage pocket; a right leg portion; a left leg portion; a right foot portion; and a left foot portion. The right foot portion and left foot portion may each include at least a first laminated panel and a second laminated panel. The first laminated panel and the second laminated panel may each include an edge, panel planar surfaces generally perpendicular to the edge, an outer layer, a middle layer, an inner layer, and a laminated panel percent elongation. The outer layer and the inner layer may be formed from a jersey knit material. The middle layer may be formed from a neoprene material comprising a thickness of about 1 mm. A seam may be formed from the first laminated panel edge and the second laminated panel edge joined to one another forming a butt joint including butt stitching going all the way through and back through the inner layer, the middle layer and the outer layer of the first laminated panel and all the way through and back through the inner layer, the middle layer and the outer layer of the second laminated panel. The seam may not include overlap between the first laminated panel edge and the second laminated panel edge. The seam may include an outer surface and an inner surface. The butt joint may include butt stitching having a seam percent elongation in the seam direction. A first waterproof tape may include a waterproof tape percent elongation in the longitudinal direction and covering the outer surface of the seam and configured to render the seam waterproof at the outer surface of the seam. A second waterproof tape may include a waterproof tape percent elongation in the longitudinal direction and covering the inner surface of the seam and configured to render the seam waterproof at the inner surface of the seam. The seam, the first waterproof tape and the second waterproof tape may include a percent elongation of at least 10%.

In embodiments, the integral storage pocket may include a zipper-closure.

In embodiments, the zipper-closure may be reversible.

In embodiments, the integral storage pocket may include a first portion integral with the body portion and a second portion opposite the first portion, wherein the second portion of the integral storage pocket is not waterproof.

In embodiments, the second portion of the integral storage pocket may include a breathable mesh material.

In embodiments, the body portion may include a chest portion, wherein the chest portion comprises the integral storage pocket.

In embodiments, the butt stitching may be a triple needle five thread flatlock 605 coverstitch.

In embodiments, the first and second stretchable waterproof tape may include a stretchable waterproof material comprising a textile layer, and barrier layer and an adhesive layer.

In embodiments, the first and second stretchable waterproof tape comprise a percent elongation of at least 10%.

In embodiments, where the seam does not include an adhesive between the first laminated panel edge and the second laminated panel edge.

According to certain embodiments, a method of constructing a packable waterproof wader may include providing a first laminated panel and a second laminated panel, wherein the first laminated panel and the second laminated panel each comprise a laminated panel percent elongation, an edge, an inner layer, a middle layer, and an outer layer, the middle layer comprising neoprene. The method may further include lining up the edge of the first laminated panel and the edge of the second laminated panel with no overlap, stitching together the first laminated panel and the second laminated panel forming a butt joint comprising butt stitching going all the way through and back through the inner layer, the middle layer and the outer layer of the first laminated panel and all the way through and back through the inner layer, the middle layer and the outer layer of the second laminated panel forming a seam, the seam not including overlap between the first laminated panel edge and the second laminated panel edge, the seam comprising an outer surface and an inner surface, wherein the butt joint comprising butt stitching comprises a seam percent elongation in the seam direction. The method may further include covering the outer surface of the seam with a first stretchable waterproof tape comprising a waterproof tape percent elongation in the longitudinal direction, wherein covering the outer surface of the seam renders the seam waterproof at the outer surface of the seam; and covering the inner surface of the seam with a second stretchable waterproof tape comprising a waterproof tape percent elongation in the longitudinal direction, wherein covering the inner surface of the seam renders the seam waterproof at the inner surface of the seam, wherein the stretchable waterproof seam comprises a percent elongation of at least 10%. The method may further include forming a right foot portion, and a left foot portion formed from laminated panels joined with stretchable waterproof seams; forming a body portion, a right leg portion, a left leg portion; and forming an integral storage pocket on the body portion, wherein the body portion, the right leg portion and the left leg portion, and the right foot portion and the left foot portion are foldable into a storage configuration, and the storage configuration is entirely insertable into the integral storage pocket.

In embodiments, the integral storage pocket may include a zipper-closure.

In embodiments, the zipper-closure may be reversible.

In embodiments, the integral storage pocket may include a first portion integral with the body portion and a second portion opposite the first portion, wherein the second portion of the integral storage pocket is not waterproof.

In embodiments, the second portion of the integral storage pocket may include a breathable mesh material.

In embodiments, the body portion may include a chest portion, wherein the chest portion comprises the integral storage pocket.

In embodiments, the butt stitching may be a triple needle five thread flatlock 605 coverstitch.

In embodiments, the first and second stretchable waterproof tape may include a stretchable waterproof material comprising a textile layer, and barrier layer and an adhesive layer.

In embodiments, the first and second stretchable waterproof tape comprise a percent elongation of at least 10%.

In embodiments, where the seam does not include an adhesive between the first laminated panel edge and the second laminated panel edge.

BRIEF DESCRIPTION OF THE DRAWINGS

The disclosed embodiments will hereinafter be described in conjunction with the appended drawings, provided to illustrate and not to limit the disclosed embodiments, wherein like designations denote like elements.

DETAILED DESCRIPTION

Figure 1:
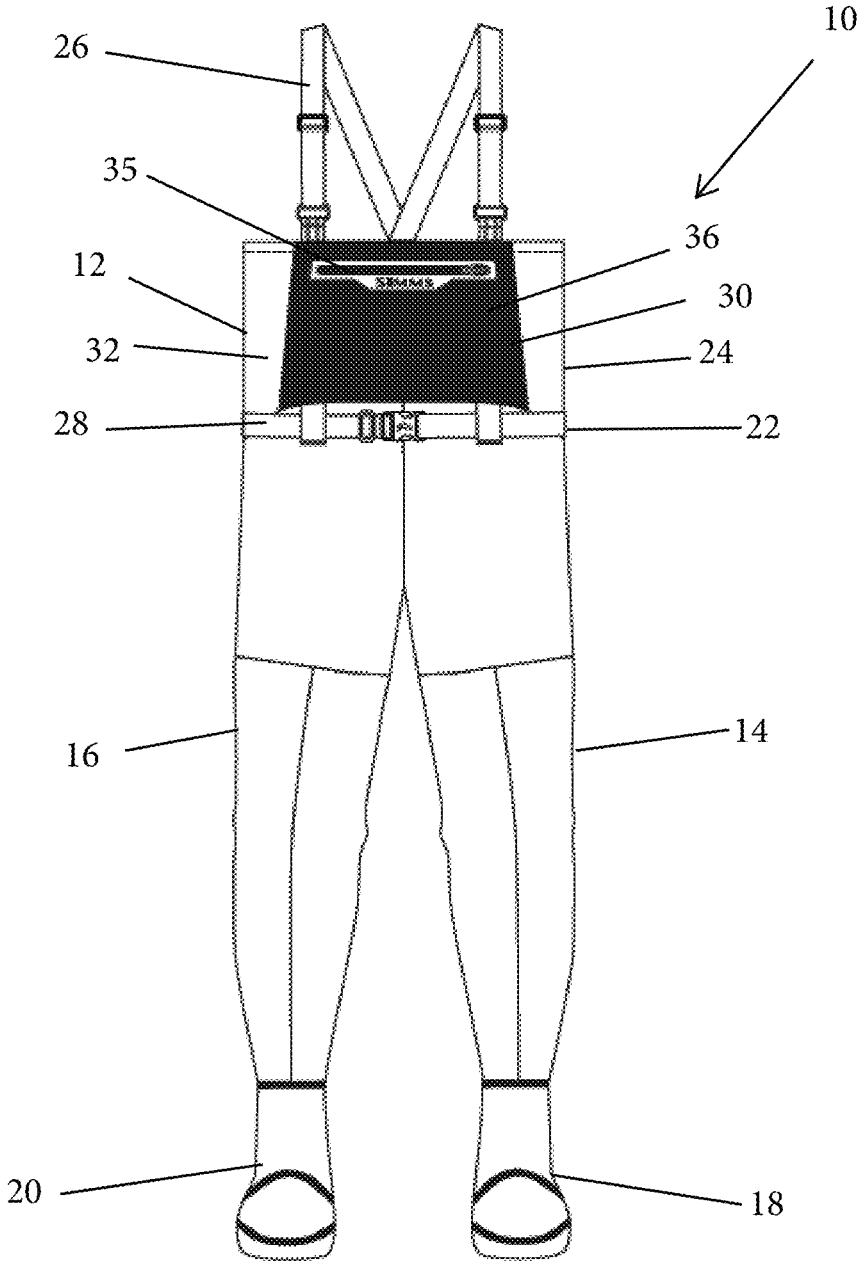
FIG. 1 is a front view of a packable waterproof fishing wader according to embodiments of the disclosure.
Figure 2:
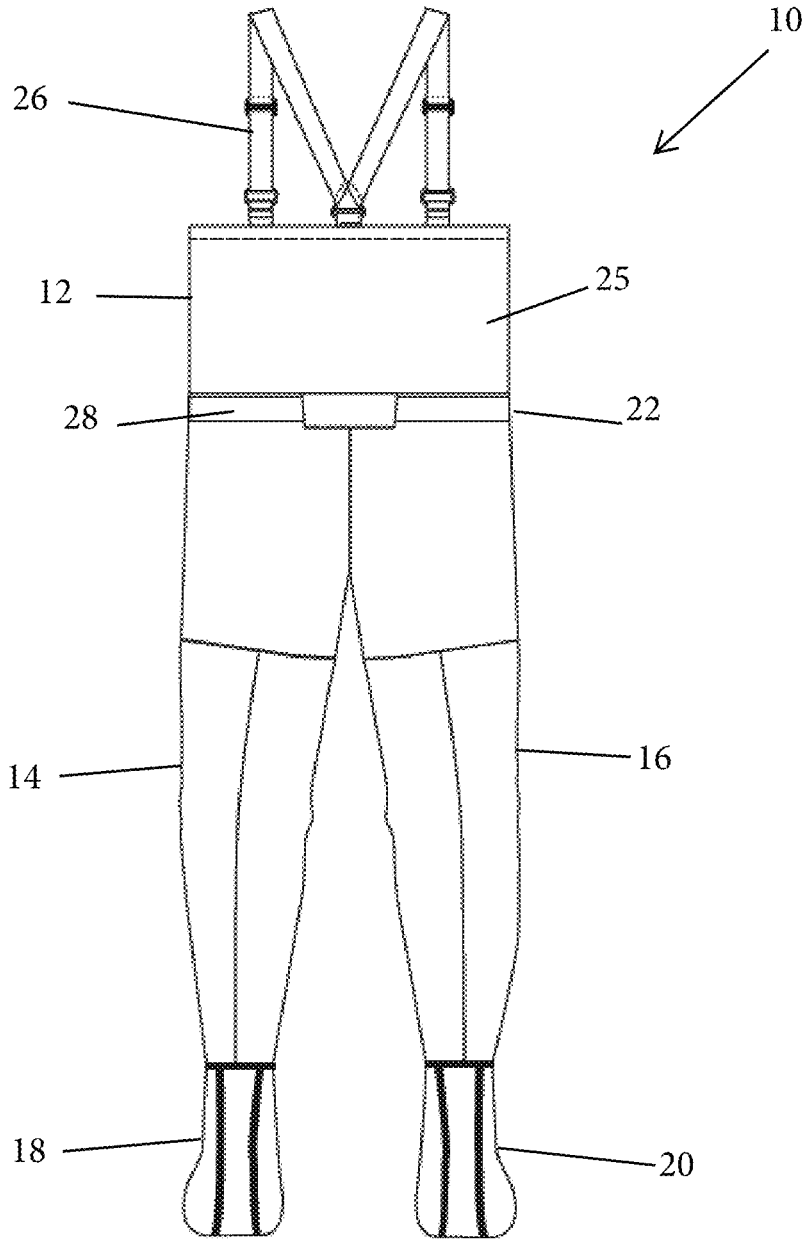
FIG. 2 is a rear view of the packable waterproof fishing wader of FIG. 1.

As used herein, unless otherwise defined, the following terms shall have the following meanings: "left" and "right" refer to a wader user's left and right sides, respectively. "Breathable" means permeable to air and water vapor. "Waterproof" means impermeable to liquid water.

As discussed herein, the components may be associated with certain percent elongations, for example, percent elongation to measure the stretch of the component. The percent elongation represents the amount a material, such as a test sample, can be stretched along a central axis. Percent elongation is given by the following equation:

$$\text{Percent Elongation}=100(LF-LO)/LO$$

Here, LF represents the length of the material at when it has been stretched, while LO represents the initial length of the material.

Embodiments of systems and methods disclosed herein will now be described with reference to the figures. Referring to FIGS. 1-11G, embodiments of a packable waterproof fishing wader 10 may have a body portion 12, a left leg portion 14, a right leg portion 16, a left foot portion 18, and a right foot portion 20. In certain embodiments, wader 10 may be a stocking foot wader. Accordingly, left foot portion 18 and right foot portion 20 may be booties or stocking feet configured to cover a user's feet before being inserted into separate waterproof boots or other outer footwear (not shown).

Figure 3:
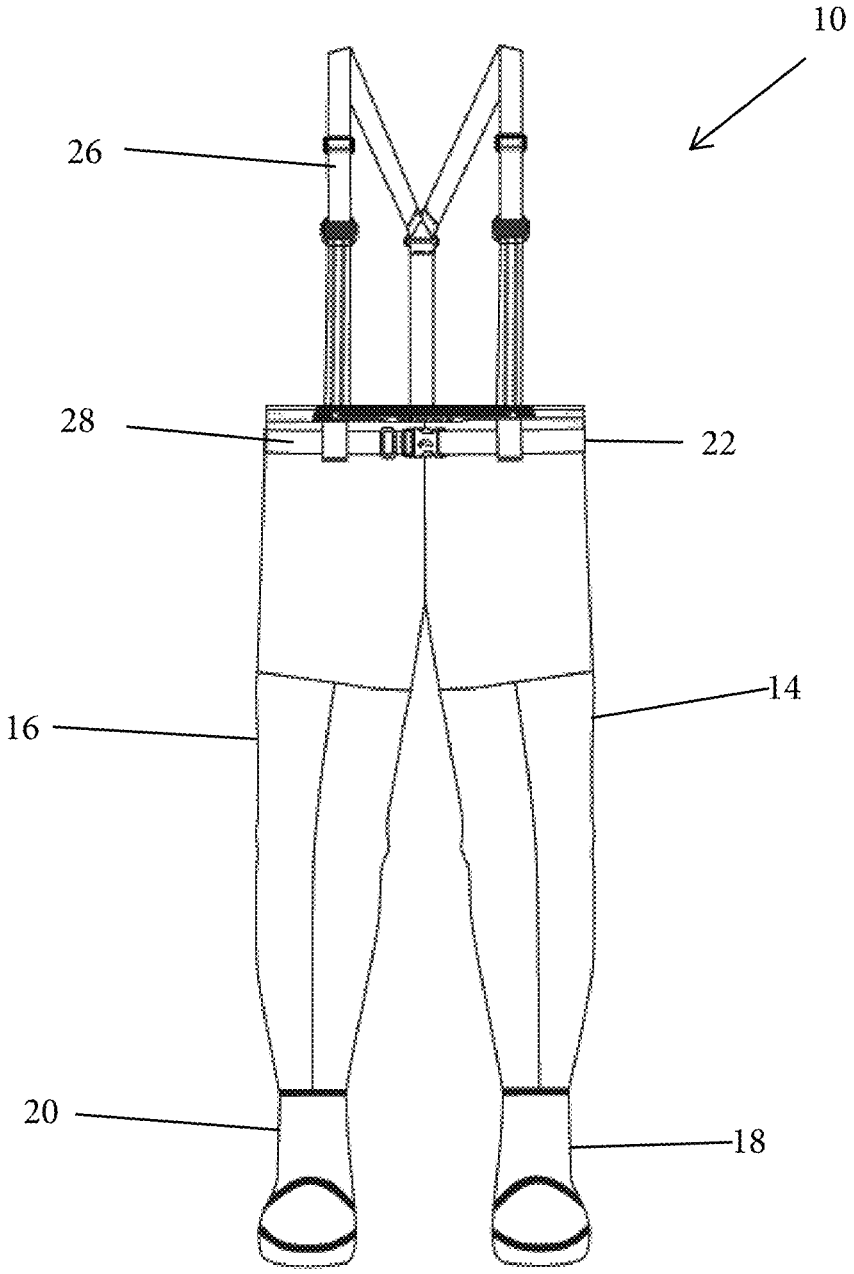
FIG. 3 is a front view of the packable waterproof fishing wader of FIG. 1 with the chest and back portions folded.
Figure 4:
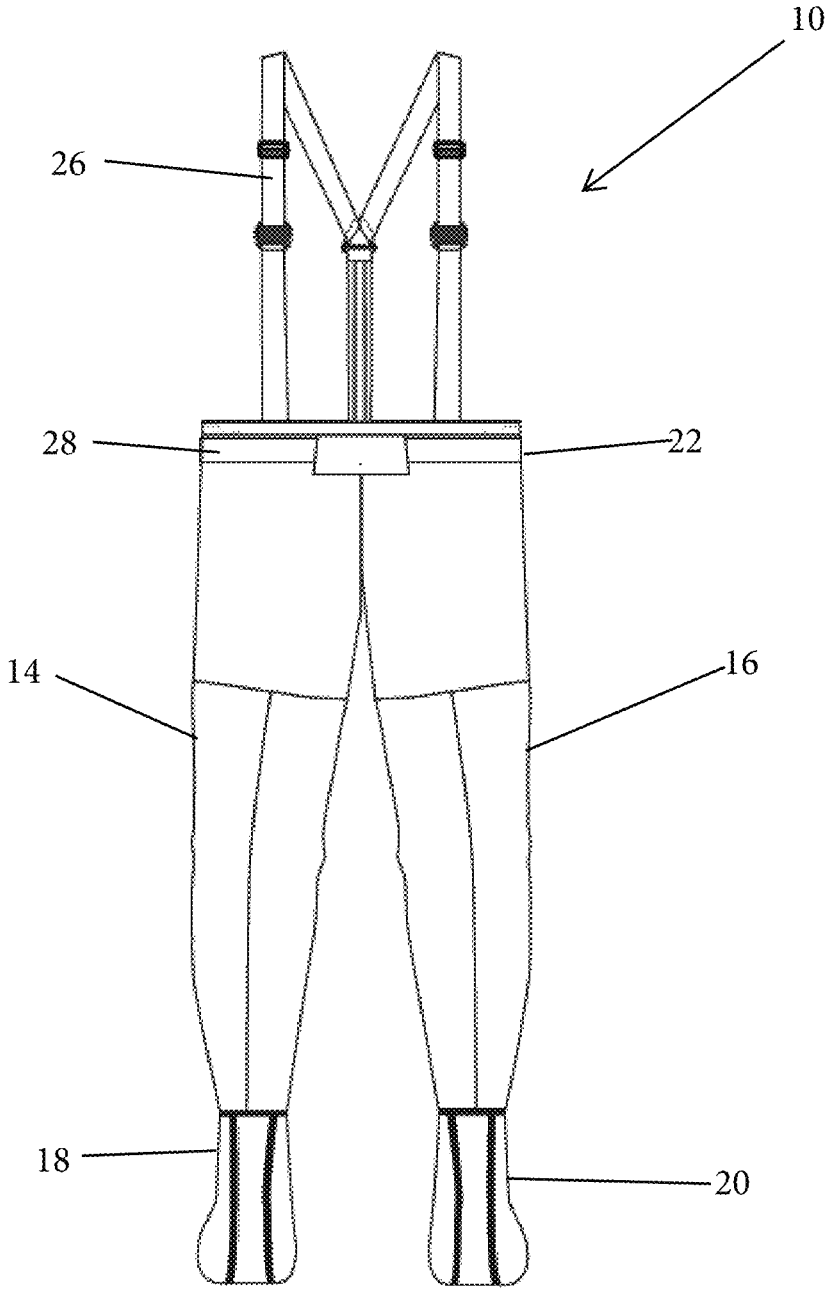
FIG. 4 is the rear view of the packable waterproof fishing wader of FIG. 1 with the chest and back portions folded.
Figure 5:
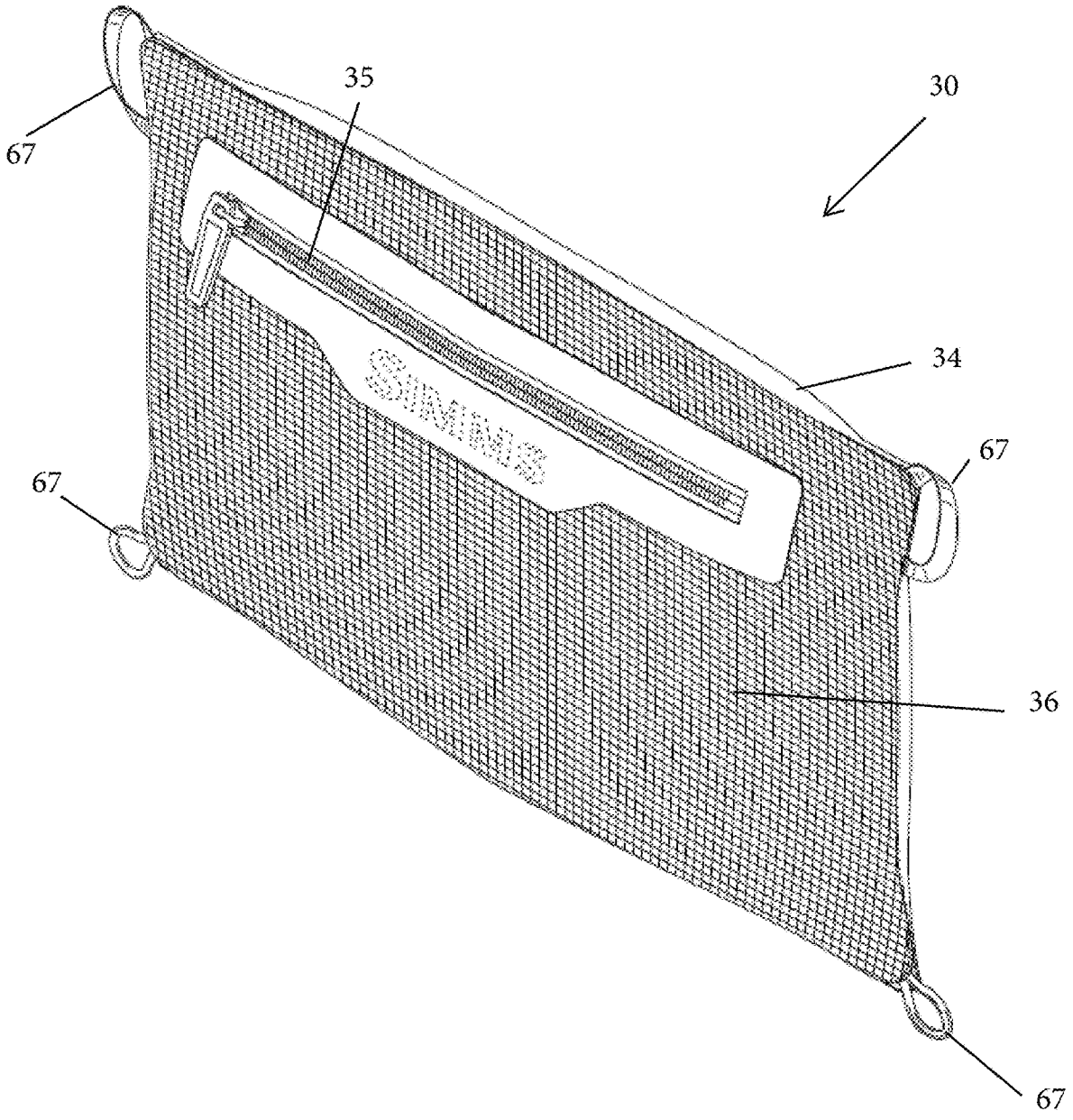
FIG. 5 is a perspective view of the integral storage pocket according to embodiments of the disclosure.
Figure 6:
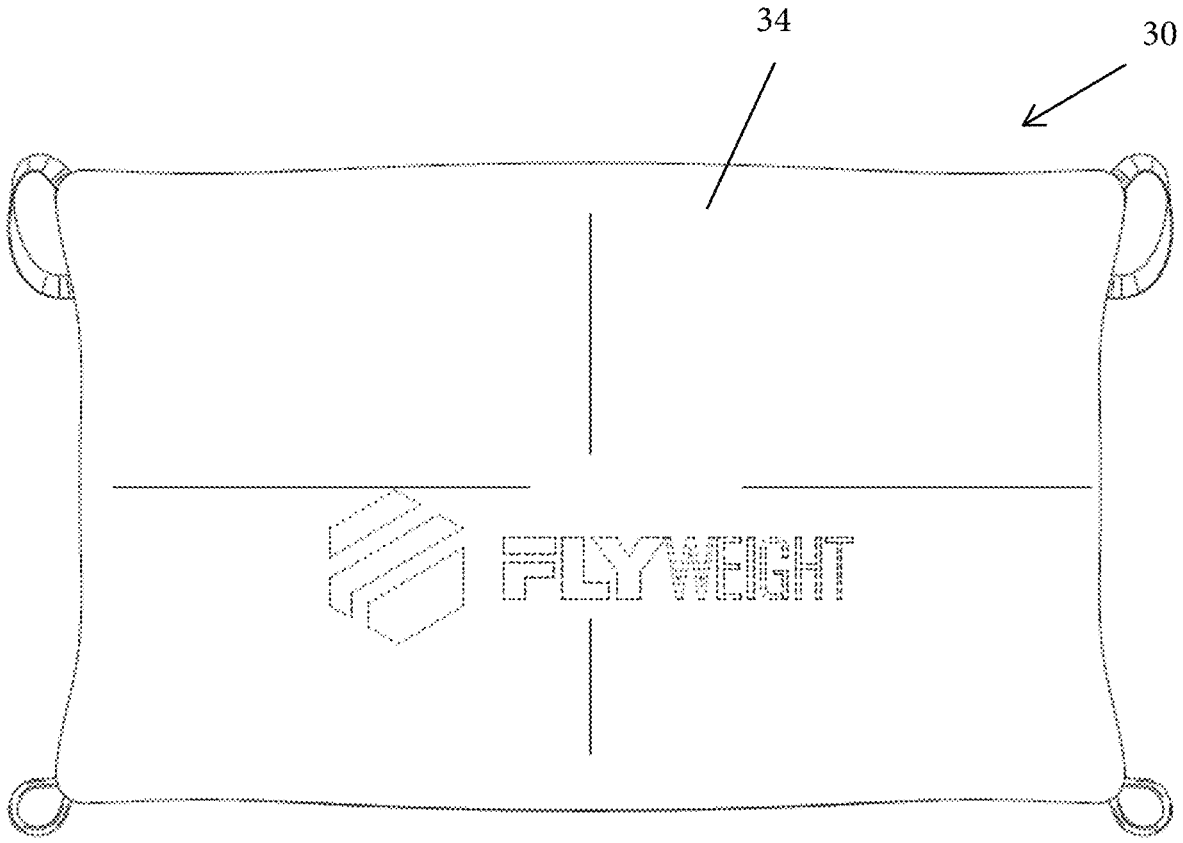
FIG. 6 is a rear view of the integral storage pocket of FIG. 5.
Figure 7:
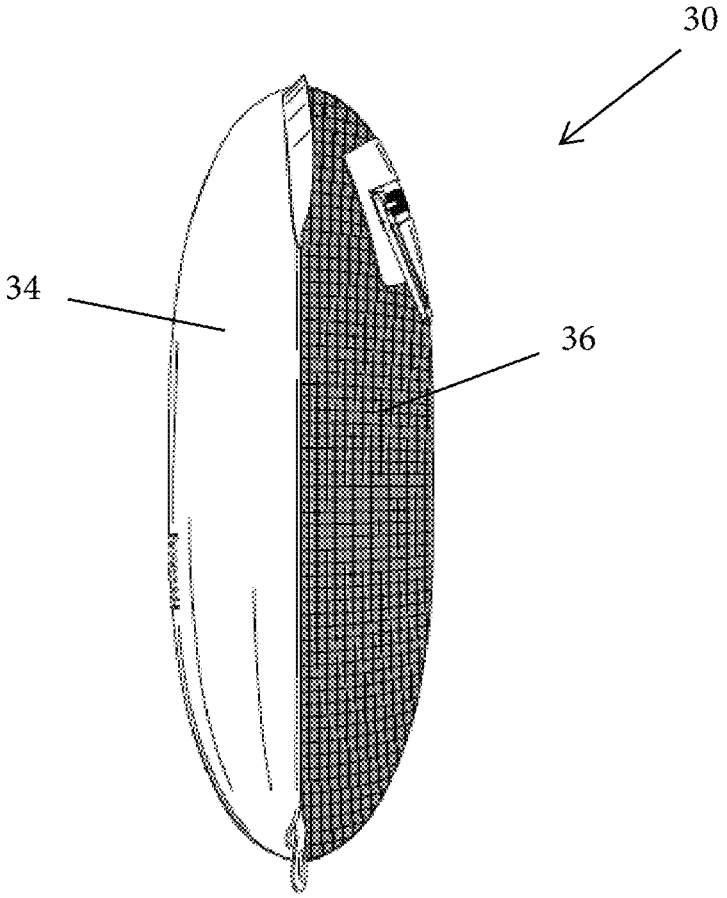
FIG. 7 is a side view of the integral storage pocket of FIG. 5.

In certain embodiments, body portion 12 may include a waist portion 22 configured to be adjacent the user's midsection, a bib or chest portion 24 configured to be adjacent the user's chest, and a back portion 25 configured to be adjacent a user's back. In one embodiment, body portion 12 may be formed from a waterproof material such as a 2.5 layer laminated nylon material. The body portion 12 may further include at least one of a pair of suspenders 26 and belt 28 to secure the body portion 12 to the user, either by looping around a user's shoulders, or securing the body portion 12 at the midsection and/or torso of the user, respectively. In certain embodiments as shown in FIGS. 3-4 chest portion 24 and back portion 25 may be foldable into waist portion 22 when chest and back coverage is not desired. In other embodiments, at least one of the chest portion 24 and back portion 25, or another part of the body portion 12, may include an integral storage pouch or pocket 30 on one of an outer surface 32 and an inner surface (not shown) thereof. In one embodiment, integral storage pocket 30 may include a first user proximal portion 34 integral with the outer surface 32 of chest portion 24 or body portion 12, and a second user distal portion 36. In one embodiment, integral storage pocket 30 may include a substantially trapezoidal shape. In other embodiments, integral storage pocket 30 may have another shape, such as a square, rectangle, circle, oval or other shape. In one embodiment, integral storage pocket 30 may include a generally horizontally-oriented zipper-closure 35 on the second user distal portion 36. In some embodiments, zipper-closure 35 may be reversible. In one embodiment, left leg portion 14, right leg portion 16 may be formed from a waterproof material. In one embodiment, such portions may include a four-layer laminated nylon material.

In one embodiment, second user distal portion 36 may be formed of the same material as first user proximal portion 34 or material that is not waterproof such as a breathable mesh material. In certain embodiments, integral storage pocket 30 may include at least one grab loop 67 on, for example, one or all four corners of the integral storage pocket 30. Grab loop 67 may be used as a grab handle for the integral storage pocket 30 during the steps of packing the waterproof fishing wader 10 into the integral storage pocket 30, as discussed below, or as an attachment point to attach the packed wader to another item, for example a belt, bag, or a rack.

Figure 8:
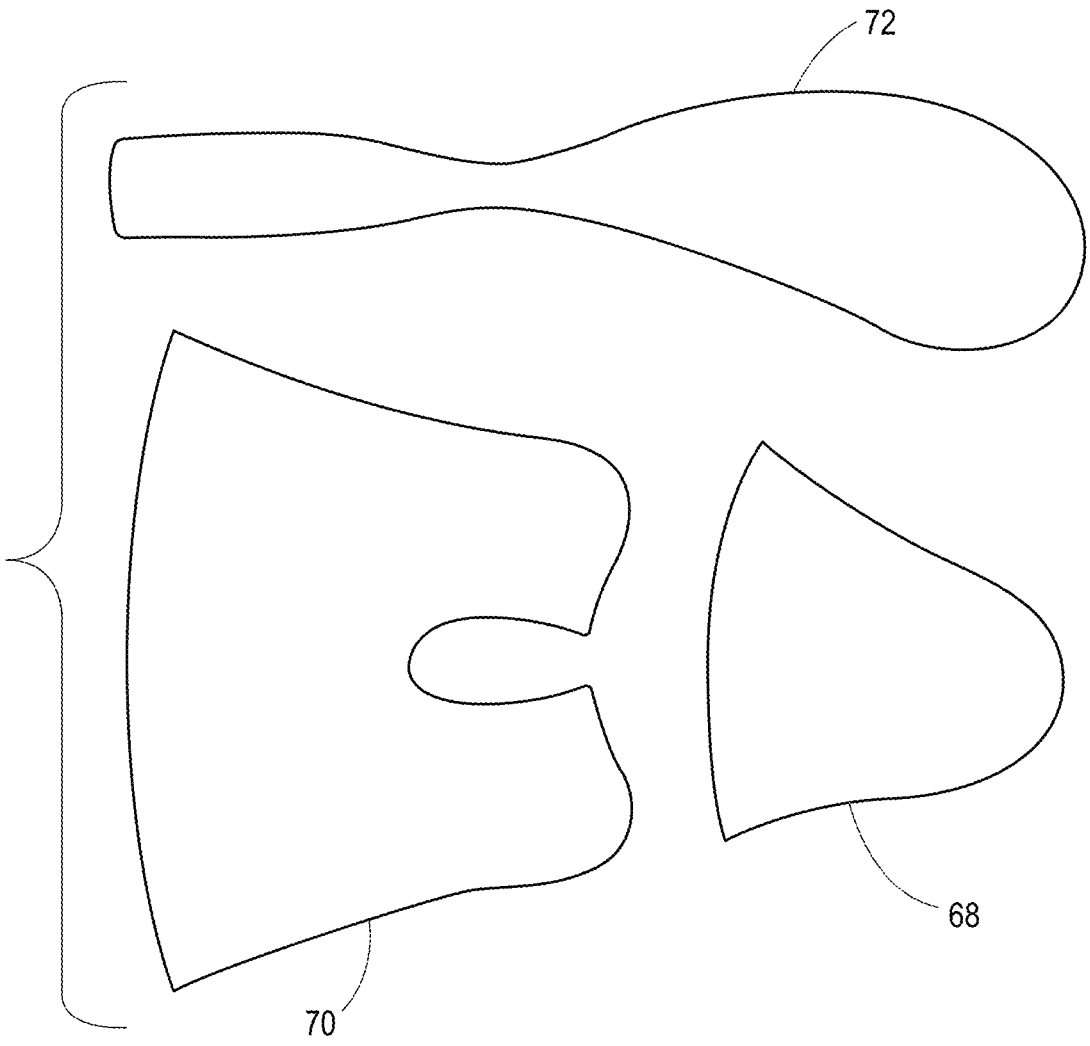
FIG. 8 is an exploded view of the toe panel, ankle panel, and sole panel of a foot portion according to embodiments of the disclosure.
Figure 9:
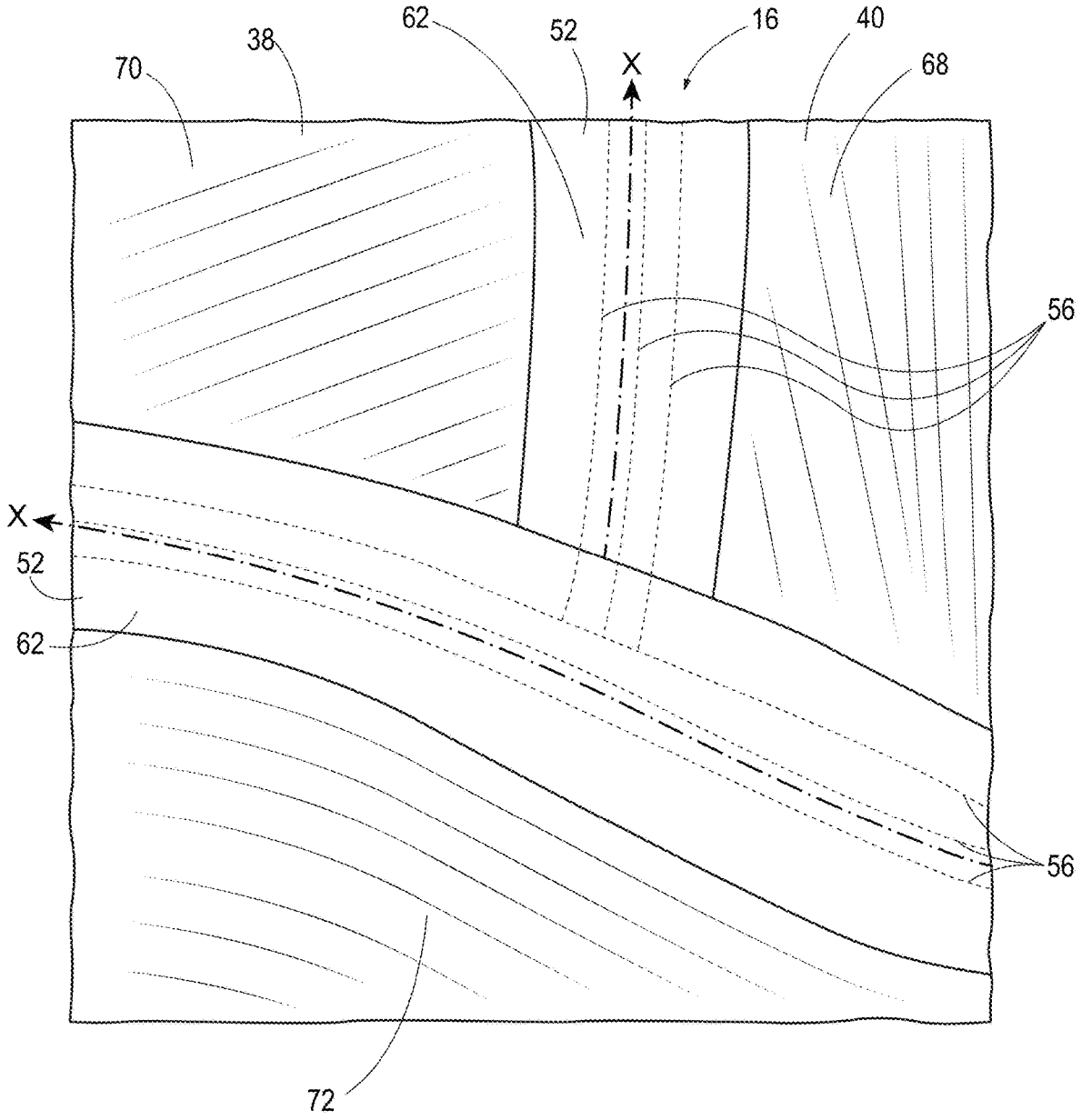
FIG. 9 is a side view of the seams of a foot portion covered with waterproof tape according to embodiments of the disclosure.
Figure 10:
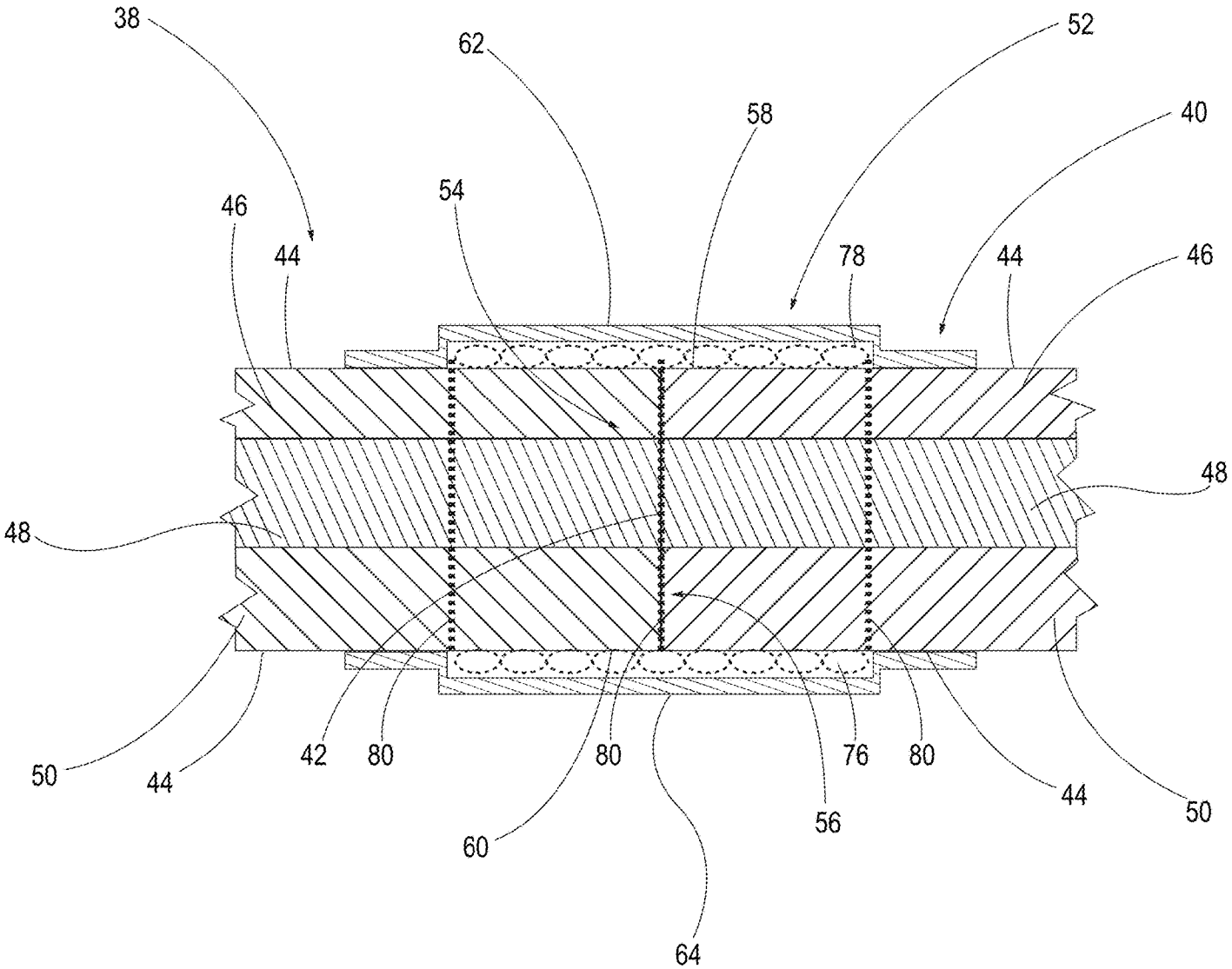
FIG. 10 is a cross-sectional view of a seam according to embodiments of the disclosure.

In some embodiments, referring to FIGS. 8-10, left foot portion 18 and right foot portion 20 may each be formed from multiple laminated panels including at least a first laminated panel 38 and a second laminated panel 40. In some embodiments, first laminated panel 38 and second laminated panel 40 may be selected from a toe panel 68, an ankle panel 70, and a sole panel 72.

First laminated panel 38 and second laminated panel 40 may each have an edge 42 (partially obscured by middle stitch 42 in FIG. 10) and panel planar surfaces 44 generally perpendicular to edge 42. In other embodiments, first laminated panel 38 and second laminated panel 40 may each further include an outer layer 46, a middle layer 48, and an inner layer 50. In some embodiments, outer layer 46 and inner layer 50 may include a jersey knit material, and middle layer 48 may include a neoprene material. In one embodiment, the neoprene material of middle layer 48 may comprise a thickness about less than 3 mm, such as, less than 2.5 mm, less than 2 mm, less than 1.5 mm, less than 1 mm, or less than 0.5 mm. In other embodiments, the neoprene material of middle layer 48 may comprise a thickness between about 0.5 mm to 1 mm, 0.5 mm to 1.5 mm, 0.5 mm to 2 mm, 1 mm to 2 mm, 1 mm to 3 mm or 2 mm to 3 mm, and ranges in between any of the foregoing. In another embodiment, the neoprene of middle layer 48 comprises a thickness of about 1 mm. In embodiments, use of a neoprene material for left foot portion 18 and right foot portion 20 of less than 3 mm, and in particular 1 mm, allows for the laminated panels of the foot portion to be sewn and taped inside and out, as described below. In other embodiments, first laminated panel 38 and second laminated panel 40 may each further include a laminated panel percent elongation.

In one embodiment, referring to FIGS. 8-10, first laminated panel 38 and second laminated panel 40 may be joined at a scam 52. Seam 52 may comprise a butt joint 54 formed by joining a first laminated panel edge 42 and a second laminated panel edge 42 forming the butt joint 54. In one embodiment, butt joint 54 is formed including butt stitching 56. In certain embodiments, butt stitching 56 may including at least one needle thread 80 going all the way through and back through all of the layers of the first laminated panel 38 and all the way through and back through all of the layers of the second laminated panel 40. In certain embodiments, the butt stitching 56 goes all the way through and back through the inner layer 50, the middle layer 48 and the outer layer 46 of the respective panels. In certain embodiments, the butt stitching 56 is clastic in the seam direction, measured by percent elongation. In one embodiment, the butt stitching may include a triple needle five thread flatlock 605 coverstitch. A triple needle five thread flatlock 605 is a stitch that is formed using three needles and five threads and provides high seam elasticity. In certain embodiments, the butt stitching 56 includes a coverstitch built with 3 different thread systems: the looper thread 76, a cover thread 78 and 2 or more needle threads 80. In these embodiments, the needle threads 80 are linked with the looper thread 76 at a first side of a scam 52 and with the cover thread 78 at a second side of a scam 52. Other embodiments may include a stitch that provides at least as much seam elasticity, measured by percent elongation, as at least one of the first and second waterproof tapes 62, 64, discussed below, and the neoprene material of middle layer 48.

In one embodiment, scam 52 may not include overlap between first laminated panel edge 42 and second laminated panel edge 42. Seam 52 may have an outer surface 58 and an inner surface 60. In embodiments, butt stitching 56 may go all the way to through the inner surface 60, and back through outer surface 58, and so on. Butt joint 54 formed including butt stitching 56 may have a scam percent elongation in the longitudinal direction X of the seam.

In one embodiment, seam 52 may further include a first tape 62. In one embodiment, first tape 62 is waterproof. In one embodiment, waterproof tape 62 may include three layers, a textile layer, a barrier layer, and an adhesive layer. In one embodiment, the textile layer includes a woven polyester with elasticity in the warp direction measured by percent elongation. In another embodiment, the barrier layer includes polyurethane. In a further embodiment, the adhesive layer includes a thermoplastic polyurethane. In certain embodiments, the waterproof tape 62 is applied using heat to soften or melt the adhesive layer. In some embodiments, applying the tape includes the use of a seam tape machine known in the art. In embodiments, waterproof tape 62 is applied such that the adhesive layer contacts the seam 52 and/or butt stitching 56. In further embodiments, waterproof tape 62 may include a width, and the butt stitching 56 may include a width, and the width of the waterproof tape 62 is greater than the width of the butt stitching 56.

In one embodiment, waterproof tape 62 creates a waterproof seam 52 when applied and covering outer surface 58 of seam 52. First waterproof tape 62 may be configured to render seam 52 waterproof at outer surface 58. Seam 52 may further include a second waterproof tape 64 creating waterproof seam 52 when applied and covering inner surface 60 of seam 52. Second waterproof tape 64 may be configured to render seam 52 waterproof from at inner surface 60. Seam 52 may further have a length, and first waterproof tape 62 and second waterproof tape 64 may have a length, when applied to seam 52, covers the length of seam 52, or at least a portion thereof. Additionally, seam 52 may further have a width, and first waterproof tape 62 and second waterproof tape 64 may have a width, when applied to seam 52, covers the width of seam 52, and butt stitching 56.

In one embodiment, waterproof tape 62 includes a waterproof tape percent elongation in the longitudinal direction X selected from at least one of at least 5%, at least 10%, at least 15%, at least 20%, at least 30%, at least 40%, at least 50%, at least 60%, up to 68%, from about 5% to about 25%, from about 10% to about 20%, from about 10% to about 15%, and ranges of any therebetween.

In one embodiment, seam 52 including butt stitching 56 and waterproof tape 62 on both outer surface 58 and inner surface 60 has a seam percent elongation in the longitudinal direction X selected from at least one of at least 5%, at least 10%, at least 15%, at least 20%, at least 30%, at least 40%, at least 50%, at least 60%, at least 70%, at least 80%, at least 90%, at least 100%, at least 110%, up to 114%, from about 5% to about 25%, from about 10% to about 20%, from about 10% to about 15%, and ranges of any therebetween. In one embodiment, seam 52 including butt stitching 56 and waterproof tape 62 on both outer surface 58 and inner surface 60 has a seam percent elongation in the longitudinal direction X, when stretched during ordinary use by a user, of from about 5% to about 25%, from about 10% to about 20%, from about 10% to about 15%, and ranges of any therebetween.

In still a further embodiment, left foot portion 18 and right foot portion 20 may include booties including at least one seam 52 including butt stitching 56 and waterproof tape 62 on both outer surface 58 and inner surface 60, and having a seam percent elongation in the longitudinal direction X that allows the bootie to be form-fitting to a user's foot, but includes enough elasticity for the bootie to be pulled onto the user's foot, and to flex with the user's foot during use.

In certain embodiments seam 52 does not include adhesive/glue at the edges 42 of first laminated panel 38 and second laminated panel 40. In other embodiments seam 52 does not include adhesive/glue anywhere.

In embodiments, the waterproof tape percent elongation and the seam percent elongation may be substantially equivalent to or greater than the laminated panel stretch characteristics of first laminated panel 38 and second laminated panel 40.

FIG. 9 depicts an embodiment where two seams 52 intersect, where seams 52 are covered by waterproof tape 62. In this embodiment, the two seams 52 join three panels 68, 70, 72. Butt stitching 56 may be visible through waterproof tape 62. The waterproof tape 62 covers the intersection of seams 52 such that the seams 52 are waterproof, even where the seams 52 intersect.

In embodiments, waterproof wader 10 including body portion 12, right leg portion 16, left leg portion 14, right foot portion 20 and left foot portion 18 may be configured to be foldable into a storage configuration 66. Storage configuration 66 may be entirely insertable into integral storage pocket 30. In embodiments, left foot portion 18 and right foot portion 20 include neoprene material of less than 3 mm, and in particular 1 mm, reducing the bulk of the waterproof wader 10 and allowing the waterproof wader 10 to be packable and insertable into the integral storage pocket 30.

In one embodiment, a method of constructing a packable waterproof wader 10 includes providing a first laminated panel 38 and a second laminated panel 40. The first laminated panel 38 and the second laminated panel 40 may each comprise an edge 42, an inner layer 50, a middle layer 48, and an outer layer 46. The middle layer 48 may include neoprene. The method may further include lining up and butting the edge 42 of the first laminated panel 38 and the edge 42 of the second laminated panel 40 with no overlap. Next, the first laminated panel 38 and the second laminated panel 40 may be stitched together to form a butt joint 54 comprising butt stitching 56 going all the way through and back through the inner layer 50, the middle layer 48 and the outer layer 46 of the first laminated panel 38 and all the way through and back through the inner layer 50, the middle layer 48 and the outer layer 46 of the second laminated panel 40 forming a seam 52. The seam 52 may be formed by not including overlap between the first laminated panel edge 42 and the second laminated panel edge 42. The method may further include covering the outer surface 58 of the seam 52 with a first stretchable waterproof tape 62 to render the seam 52 waterproof at the outer surface 58 of the seam 52, and covering the inner surface 60 of the seam 52 with a second stretchable waterproof tape 64 to render the seam 52 waterproof at the outer surface 58 of the seam such that the covering of the inner surface 60 and the outer surface 58 of the seam 52 with the first stretchable waterproof tape 62 and the second stretchable waterproof tape 64 forms the stretchable waterproof seam 52. The waterproof tape percent elongation maybe substantially equivalent to or greater than the stretch characteristics of the first laminated panel 38 and the second laminated panel 40. The method may further include forming a right foot portion 20, and a left foot portion 18 formed from laminated panels 38, 40 joined with stretchable waterproof seams 52, forming a body portion 12, a right leg portion 16, a left leg portion 14, and forming an integral storage pocket 30 on the body portion 12 such that the body portion 12, the right leg portion 16 and the left leg portion 14, and the right foot portion 16 and the left foot portion 18 are foldable into a storage configuration 66. The storage configuration 66 may be entirely insertable into the integral storage pocket 30.

FIGS. 11A-11G show an embodiment including steps of folding the packable waterproof fishing wader 10 into the storage configuration 66. The body portion 12, the right leg portion 16 and the left leg portion 14, and the right foot portion 16 and the left foot portion 18 are foldable into a compact shape approximately the size and shape of the interior of integral storage pocket 30 so that the packable waterproof fishing wader 10 may be packed and stored within integral storage pocket 30.

Figure 11A:
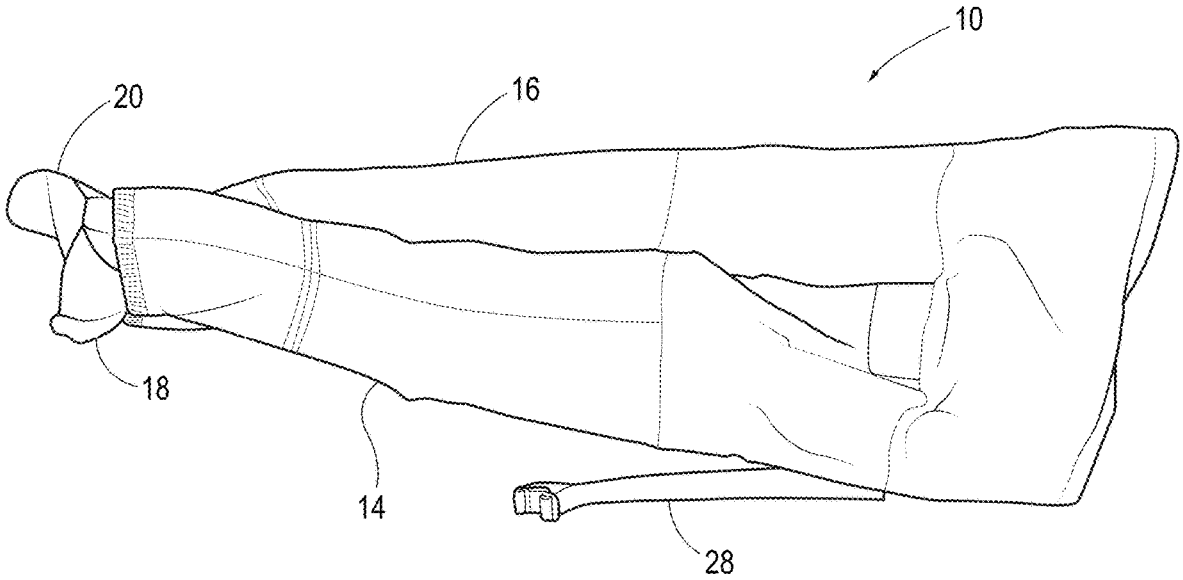
FIG. 11A-11G show the steps of folding the packable waterproof fishing wader into the storage configuration of the packable waterproof fishing wader according to embodiments of the disclosure.

In Step 1, referring to FIG. 11A, the packable waterproof fishing wader 10 may be placed on a flat surface with the chest portion 24 facing down and the right leg portion 16 and the left leg portion 14 folded together such that the right foot portion 16 and the left foot portion 18 overlap.

Figure 11B:
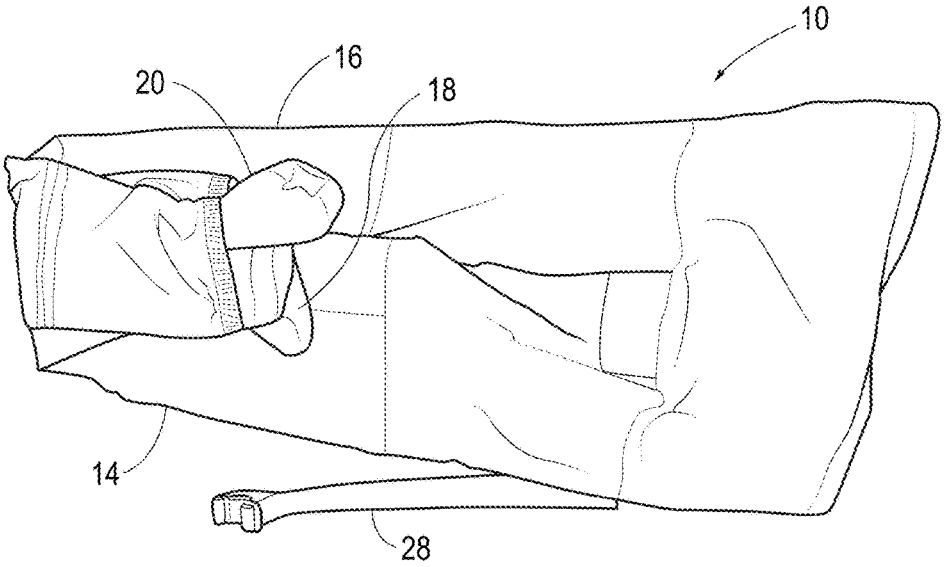

In Step 2, referring to FIG. 11B, the overlapped right foot portion 16 and the left foot portion 18 may be folded over the right leg portion 16 and the left leg portion 14.

Figure 11C:
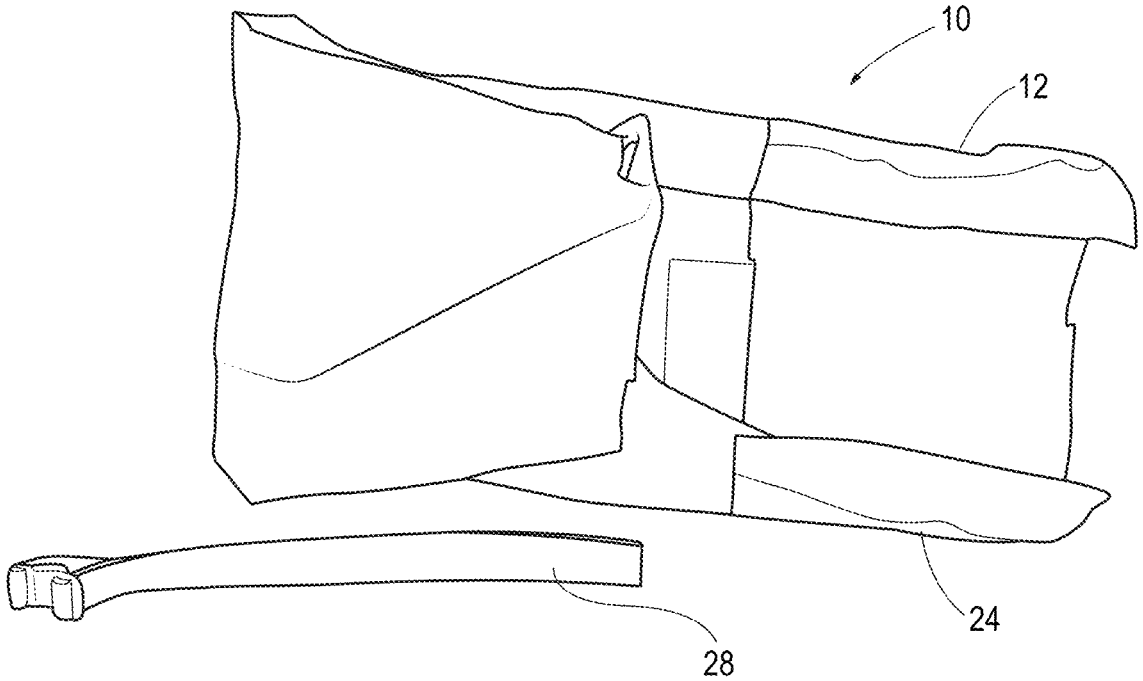

In Step 3, referring to FIG. 11C, the sides of the body portion 12 may be folded over to match the width of the folded over the right leg portion 16 and the left leg portion 14. The folded over, overlapped right foot portion 16 and the left foot portion 18 may again be folded over the right leg portion 16 and the left leg portion 18.

Figure 11D:
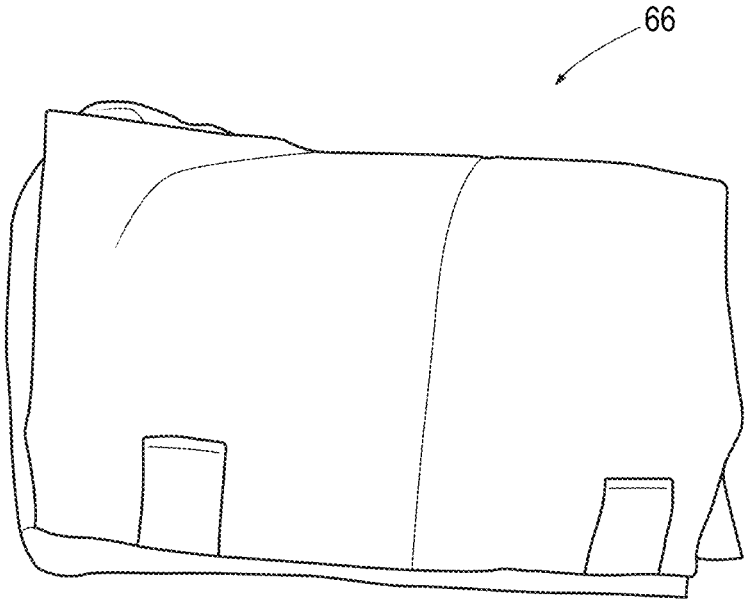

In Step 4, referring to FIG. 11D, the folded over, overlapped right foot portion 16 and the left foot portion 18 may again be folded over two more times until the folded over, overlapped right foot portion 16 and the left foot portion 18 aligns with the folded body portion 12 forming a storage configuration 66.

Figure 11E:
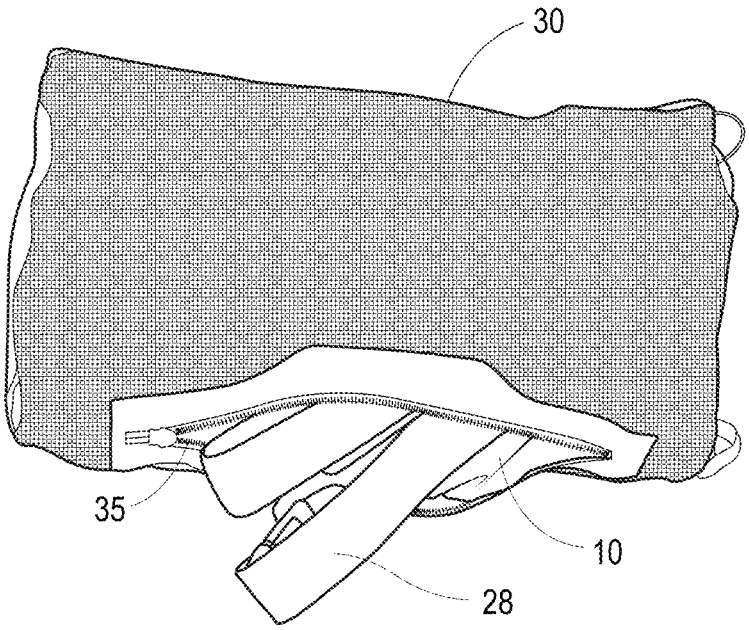

In Step 5, referring to FIG. 11E, the storage configuration 66 and belt 28 may be inserted into the integral storage pocket 30.

Figure 11F:
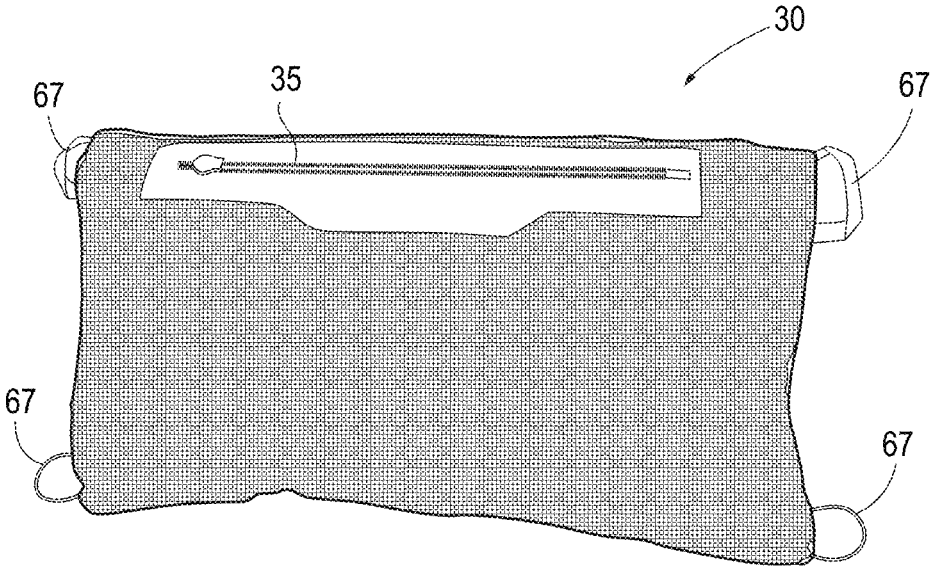

In Step 6, referring to FIG. 11F, the grab loops 67 may be pulled on to ensure the corners of the integral storage pocket 30 are pulled out. Zipper-closure 35 may then be closed.

Figure 11G:
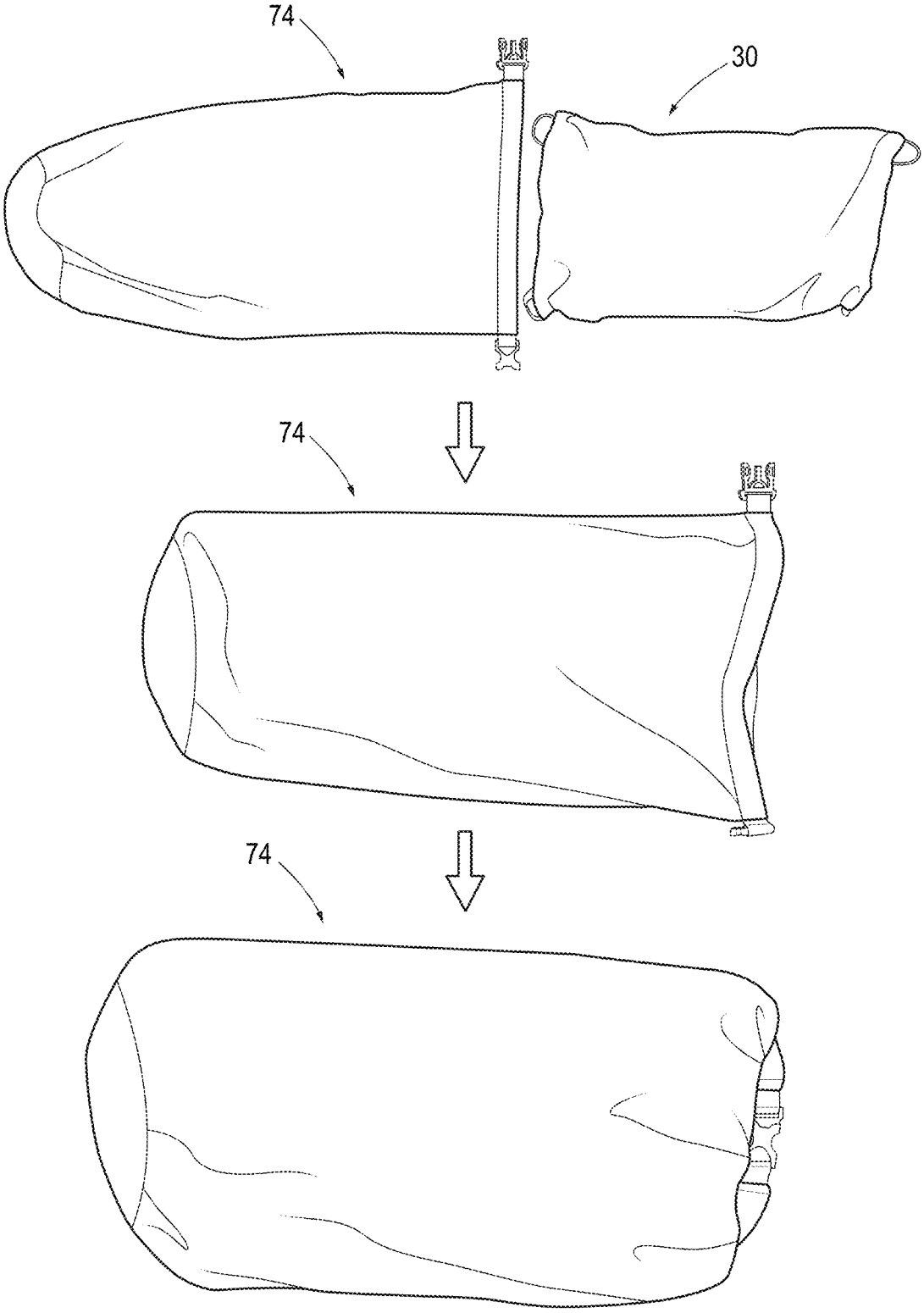

In Step 7, referring to FIG. 11G, the waterproof fishing wader 10 packed into the integral storage pocket 30 may be inserted into an optional stuff bag 74.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

It should be noted that the use of particular terminology when describing certain features or embodiments of the disclosure should not be taken to imply that the terminology is being re-defined herein to be restricted to include any specific characteristics of the features or embodiments of the disclosure with which that terminology is associated. Terms and phrases used in this application, and variations thereof, especially in the appended claims, unless otherwise expressly stated, should be construed as open-ended as opposed to limiting. As examples of the foregoing, the term "including" should be read to mean "including, without limitation," "including but not limited to," or the like; the term "comprising" as used herein is synonymous with "including," "containing," or "characterized by," and is inclusive or open-ended and does not exclude additional, unrecited elements or method steps; the term "having" should be interpreted as "having at least"; the term "such as"

should be interpreted as "such as, without limitation"; the term "includes" should be interpreted as "includes but is not limited to"; the term "example" is used to provide exemplary instances of the item in discussion, not an exhaustive or limiting list thereof, and should be interpreted as "example, but without limitation"; adjectives such as "known," "normal," "standard," and terms of similar meaning should not be construed as limiting the item described to a given time period or to an item available as of a given time, but instead should be read to encompass known, normal, or standard technologies that may be available or known now or at any time in the future; and use of terms like "preferably," "preferred," "desired," or "desirable," and words of similar meaning should not be understood as implying that certain features are critical, essential, or even important to the structure or function of the present disclosure, but instead as merely intended to highlight alternative or additional features that may or may not be utilized in a particular embodiment.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. The terms "about" or "approximate" and the like are synonymous and are used to indicate that the value modified by the term has an understood range associated with it, where the range may be ±20%, ±15%, ±10%, ±5%, or ±1%. The term "substantially" is used to indicate that a result (e.g., measurement value) is close to a targeted value, where close may mean, for example, the result is within 80% of the value, within 90% of the value, within 95% of the value, or within 99% of the value. Also, as used herein "defined" or "determined" may include "predefined" or "predetermined" and/or otherwise determined values, conditions, thresholds, measurements, and the like.

What is claimed is:

1. A packable waterproof fishing wader comprising:

a body portion comprising an integral storage pocket;

a right leg portion;

a left leg portion;

a right foot portion; and a left foot portion;

the right foot portion and left foot portion each comprising at least a first laminated panel and a second laminated panel, the first laminated panel and the second laminated panel each comprising an edge, panel planar surfaces generally perpendicular to the edge, an outer layer, a middle layer, an inner layer, and a laminated panel percent elongation;

the outer layer and the inner layer comprising a jersey knit material;

the middle layer comprising a neoprene material comprising a thickness of about 1 mm;

a seam comprising the first laminated panel edge and the second laminated panel edge joined to one another comprising a butt joint comprising butt stitching going all the way through and back through the inner layer, the middle layer and the outer layer of the first laminated panel and all the way through and back through the inner layer, the middle layer and the outer layer of the second laminated panel, the seam not including overlap between the first laminated panel edge and the second laminated panel edge, the seam comprising an outer surface and an inner surface, wherein the butt joint comprising butt stitching comprises a seam percent elongation in the seam direction;

a first waterproof tape comprising a waterproof tape percent elongation in the longitudinal direction and covering the outer surface of the seam and configured to render the seam waterproof at the outer surface of the seam; and a second waterproof tape comprising a waterproof tape percent elongation in the longitudinal direction and covering the inner surface of the seam and configured to render the seam waterproof at the inner surface of the seam;

wherein the seam, the first waterproof tape and the second waterproof tape comprise a percent elongation of at least 10%, wherein the body portion, the right leg portion and left leg portion, and the right foot portion and left foot portion are configured to be foldable into a storage configuration, and the storage configuration is entirely insertable into the integral storage pocket.

2. The packable waterproof fishing wader of claim 1, wherein the integral storage pocket further comprises a zipper-closure.

3. The packable waterproof fishing wader of claim 2, wherein the zipper-closure is reversible.

4. The packable waterproof fishing wader of claim 1, wherein the integral storage pocket further comprises a first portion integral with the body portion and a second portion opposite the first portion, wherein the second portion of the integral storage pocket is not waterproof.

5. The packable waterproof fishing wader of claim 4, wherein the second portion of the integral storage pocket comprises a breathable mesh material.

6. The packable waterproof fishing wader of claim 1, wherein the body portion further comprises a chest portion, wherein the chest portion comprises the integral storage pocket.

7. The packable waterproof fishing wader of claim 1, wherein the butt stitching comprises a triple needle five thread flatlock 605 coverstitch.

8. The packable waterproof fishing wader of claim 1, wherein the first waterproof tape and the second waterproof tape each comprise a stretchable waterproof material comprising a textile layer, a barrier layer and an adhesive layer.

9. The packable waterproof fishing wader of claim 1, where the seam does not include an adhesive between the first laminated panel edge and the second laminated panel edge.

10. A method of constructing a packable waterproof wader, the method comprising:

providing a first laminated panel and a second laminated panel, wherein the first laminated panel and the second laminated panel each comprise a laminated panel percent elongation, an edge, an inner layer, a middle layer, and an outer layer, the middle layer comprising neoprene, lining up the edge of the first laminated panel and the edge of the second laminated panel with no overlap, stitching together the first laminated panel and the second laminated panel forming a butt joint comprising butt stitching going all the way through and back through the inner layer, the middle layer and the outer layer of the first laminated panel and all the way through and back through the inner layer, the middle layer and the outer layer of the second laminated panel forming a seam, the seam not including overlap between the first laminated panel edge and the second laminated panel edge, the seam comprising an outer surface and an inner surface, wherein the butt joint comprising butt stitching comprises a seam percent elongation in the seam direction;

covering the outer surface of the seam with a first stretchable waterproof tape comprising a waterproof tape percent elongation in the longitudinal direction, wherein covering the outer surface of the seam renders the seam waterproof at the outer surface of the seam;

covering the inner surface of the seam with a second stretchable waterproof tape comprising a waterproof tape percent elongation in the longitudinal direction, wherein covering the inner surface of the seam renders the seam waterproof at the inner surface of the seam;

wherein the covering of the inner and outer surfaces of the seam with the first stretchable waterproof tape and the second stretchable waterproof tape forms a stretchable waterproof seam;

wherein the stretchable waterproof seam comprises a percent elongation of at least 10%, forming a right foot portion, and a left foot portion formed from laminated panels joined with stretchable waterproof seams;

forming a body portion, a right leg portion, a left leg portion; and forming an integral storage pocket on the body portion, wherein the body portion, the right leg portion and the left leg portion, and the right foot portion and the left foot portion are foldable into a storage configuration, and the storage configuration is entirely insertable into the integral storage pocket.

11. The method of claim 10, further providing the integral storage pocket with a zipper-closure.

12. The method of claim 11, wherein the zipper-closure is reversible.

13. The method of claim 10, wherein the integral storage pocket further comprises a first portion integral with the body portion and a second portion opposite the first portion, wherein the second portion of the integral storage pocket is not waterproof.

14. The method of claim 13, wherein the second portion of the integral storage pocket comprises a breathable mesh material.

15. The method of claim 10, wherein the body portion further comprises a chest portion, wherein the chest portion comprises the integral storage pocket.

16. The method of claim 10, wherein the butt stitching comprises a triple needle five thread flatlock 605 coverstitch.

17. The method of claim 10, wherein the first and second stretchable waterproof tape comprise a stretchable waterproof material comprising a textile layer, and barrier layer and an adhesive layer.

18. The method of claim 17, wherein the first stretchable waterproof tape and the second stretchable waterproof tape each comprise a percent elongation of at least 10%.

19. The method of claim 10, where the seam does not include an adhesive between the first laminated panel edge and the second laminated panel edge.

* * * * *